US005267407A

United States Patent [19]

Bornancini

[11] Patent Number: 5,267,407

[45] Date of Patent: Dec. 7, 1993

[54] SAFETY DEVICE FOR SEMIAUTOMATIC PISTOL

[75] Inventor: Jose C. M. Bornancini, Porto Alegre, Brazil

[73] Assignee: Forjas Taurus S/A, Porto Alegre, Brazil

[21] Appl. No.: 866,447

[22] Filed: Apr. 10, 1992

[30] Foreign Application Priority Data

Apr. 18, 1991 [BR] Brazil ..... PI 9001880

[51] Int. Cl.[5] ..... F41A 17/64

[52] U.S. Cl. ..... 42/70.08; 89/148

[58] Field of Search ..... 42/69.03, 70.04, 70.05, 42/70.06, 70.08; 89/148

[56] References Cited

U.S. PATENT DOCUMENTS

| | | | |
|---|---|---|---|
| 3,724,113 | 4/1973 | Ludwig | 42/70.08 |
| 3,830,002 | 8/1974 | Volkmar | 42/70.08 |
| 4,589,327 | 5/1986 | Smith | 42/70.08 |

*Primary Examiner*—Stephen C. Bentley
*Attorney, Agent, or Firm*—Bachman & La Pointe

[57] ABSTRACT

The present invention relates to an "IMPROVED SAFETY DEVICE FOR SEMIAUTOMATIC PISTOL". The safety device comprises a three-position safety register in which a raised position (A) actuates a pistol locking mechanism and a lowered positioned (B) actuates an uncocking mechanism of a hammer with automatic return to a horizontal neutral position (C) allowing shooting with the pistol.

4 Claims, 9 Drawing Sheets

SAFETY DEVICE FOR SEMIAUTOMATIC PISTOL

BACKGROUND OF THE INVENTION

The state of art knows single action semiautomatic pistols such as the Colt 1911 gun, whose hammer can be cocked by the thumb or by sliding backward the breechblock either manually or due to a shot. In both cases, the hammer always stands in the same position, somewhat backwards, with it being necessary only to exert some pressure of the forefinger on the trigger to fire off.

Guns of this kind can be locked with the hammer in the cocked position. The only way to uncock the gun after its unlocking is to thumb the hammer and lead it down, little by little, after pulling the trigger.

The risk of accidental shots due to trigger sensitivity when the gun is unlocked requires it being carried inside a holster always locked or with the hammer down and unlocked. In both cases, a sudden draw out of the pistol requires a conscious act to either unlock or to cock it with the thumb.

For this reason, double action pistols were developed. These pistols, when carried unlocked and in perfect safety conditions, can fire the first shot just by pulling the trigger which, in a long stroke, such as with revolvers, cocks the hammer, releasing it further for shooting in a continuous motion. After the first shot, the hammer stands cocked like with single action pistols.

Nowadays, there are four main kinds of safety devices for double action pistols, among which there are some which afford or help afford a safe hammer uncocking. The oldest one is a safety lever assembled in the sliding breechblock, which nowadays appears in WHALTER mod. P-38, PPK, PP and SMITH & WESSON cal. 9 mm and 0.45 pistols, and in RUGER mod. P-85 and BERETA mod. 92 weapons. In all these models, when the latch bolt is turned down to uncock the hammer, it remains down positioned, requiring a conscious turning up double action shooting. An exception is made with regard to the STEIR GB 9 mm pistol whose latch, when lowered to uncock the hammer, safely turns back automatically to the unlock position to allow immediate double action.

Similar devices can be found in pistols such as the HECKLER & KOCH P9 and STAR M 30, which have a safety lever assembled in the sliding breechblock. When activated, the safety lever clocks the firing pin but does not uncock the hammer, which requires further pulling of the trigger. This device requires the pulling of the trigger, after duly setting the locking lever to the lock position, in order to uncock the hammer without shooting. Additionally, it is necessary to unlock the gun for further double action shooting.

Such locking devices have the inconvenience of being assembled in the sliding breechblock, making difficult operation with the thumb, and making possible an unintentional action, when operating manually over the grip to hammer cocking, to tuck the pistol in a narrow holster or to pull it out of the helster.

Another device is the uncocking lever, appearing in the SIG-SAUER P-226 pistols. This device is not properly a safety device, but rather a lever located in the front grip, which, when lowered with the trigger pulled, safely uncocks the hammer. After that, the lever turns up automatically to the initial position, allowing double action shooting.

Another device employs a lock assembled into the frame that just blocks the sear. It can be applied only when the trigger is pulled, and requires that the hammer be lowered through manual control, while pulling the trigger for uncocking. This device appears in the BERETA 92 S, BENELLI, BERNARDELLI, CZ-75 and TAURUS PT 99 and 92, among others.

This device allows one to carry the above pistols cocked and locked, in the way some self defense experts recommend based on the COLT 1911. However, the double action advantage is jeopardized when the gun is set to operate in this condition due to the dangerous uncocking required.

OBJECT OF THE INVENTION

An improved safety device for semiautomatic pistol is the object of the present invention. The device comprises a set of pieces specially configured, by which it promotes either the gun locking or the safe uncocking of the hammer with simultaneous disablement of the trigger.

SUMMARY OF THE INVENTION

It is in the scope of the present invention to provide an improved safety device for semiautomatic pistols of the kind assembled into the frame of the pistol. The safety device includes a three-position rotary safety register in which the raised position actuates the pistol locking mechanism, the lowered position actuates the hammer uncocking mechanism and the horizontal neutral position, to which the register automatically returns from the lowered position, allows shooting with the pistol. The safety register is composed of two actuating keys, with one key located on each side of the pistol and being arranged such that the right-hand key has an axle at right angles with the pistol on which are mounted the hammer and the firing pin block, and such that the left-hand key has means for fixing this axle and an arm fitted with a pin parallel to the axle of this key which acts in a groove adjacent to the hole of the firing pin block lever. A firing pin is provided with a ramp in the respective cavity which houses the firing pin block and is also fitted with a stop, the lower portion of which is provided with a ramp and which has an upper flat face with a circular cavity to house respective spring. Laterally, this stop has a downward extension and is fitted with a groove in which actuates the cylindrical projection of the firing pin block lever; Additionally, in the left-hand key, is fitted a set of two pins with respective springs.

BRIEF DESCRIPTION OF THE DRAWINGS

The advantages and technical results of the invention will become evident from the detailed description that follows, referring to the drawings attached hereto in which.

DETAILED DESCRIPTION OF THE INVENTION

Figure 1B:
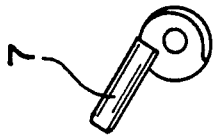
FIGS. 1A–1D illustrate a side-view of a pistol which incorporates the safety device of the present invention.
Figure 1C:
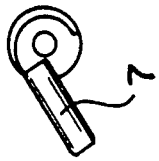
Figure 1D:
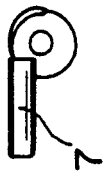
Figure 1A:
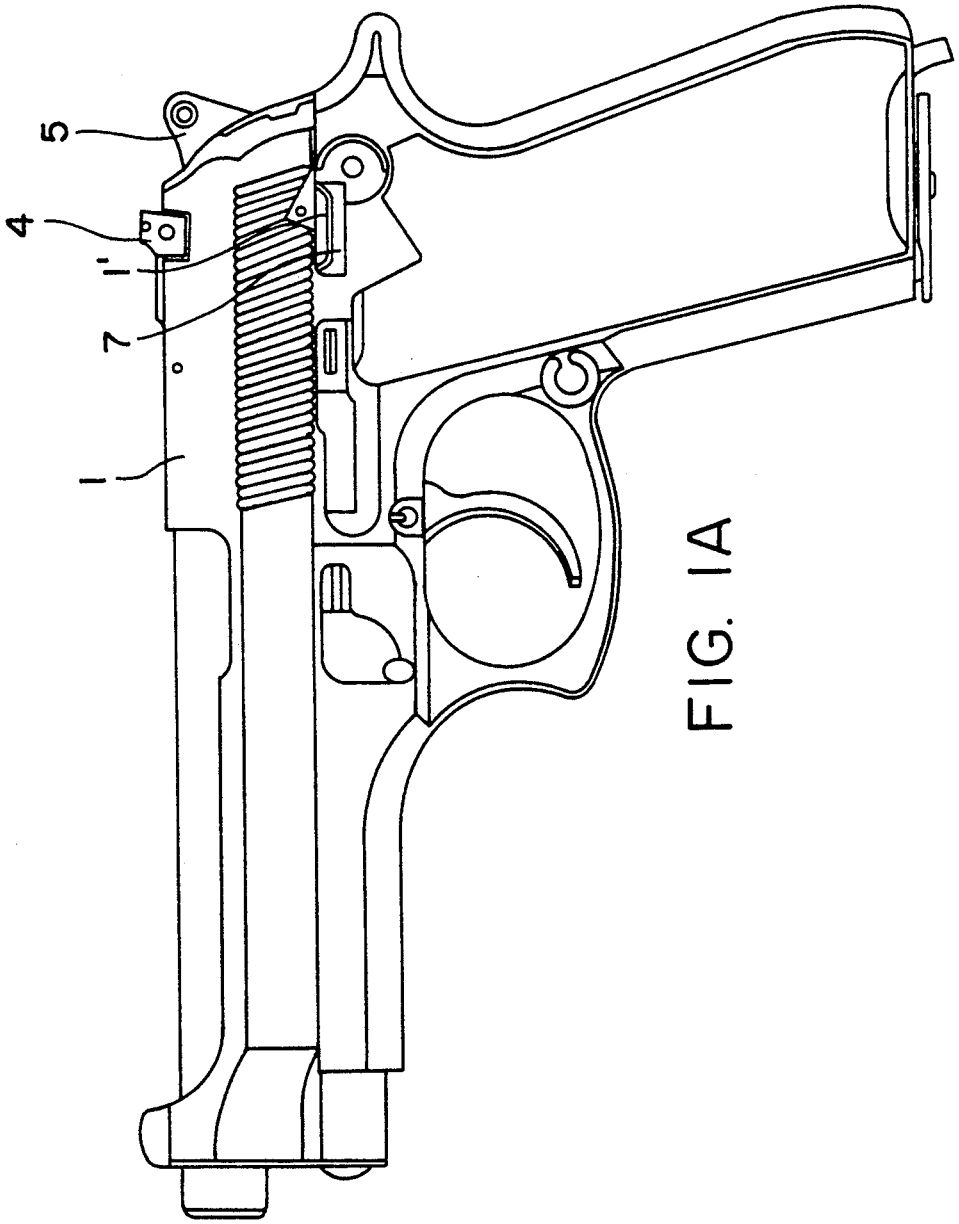
Figure 2:
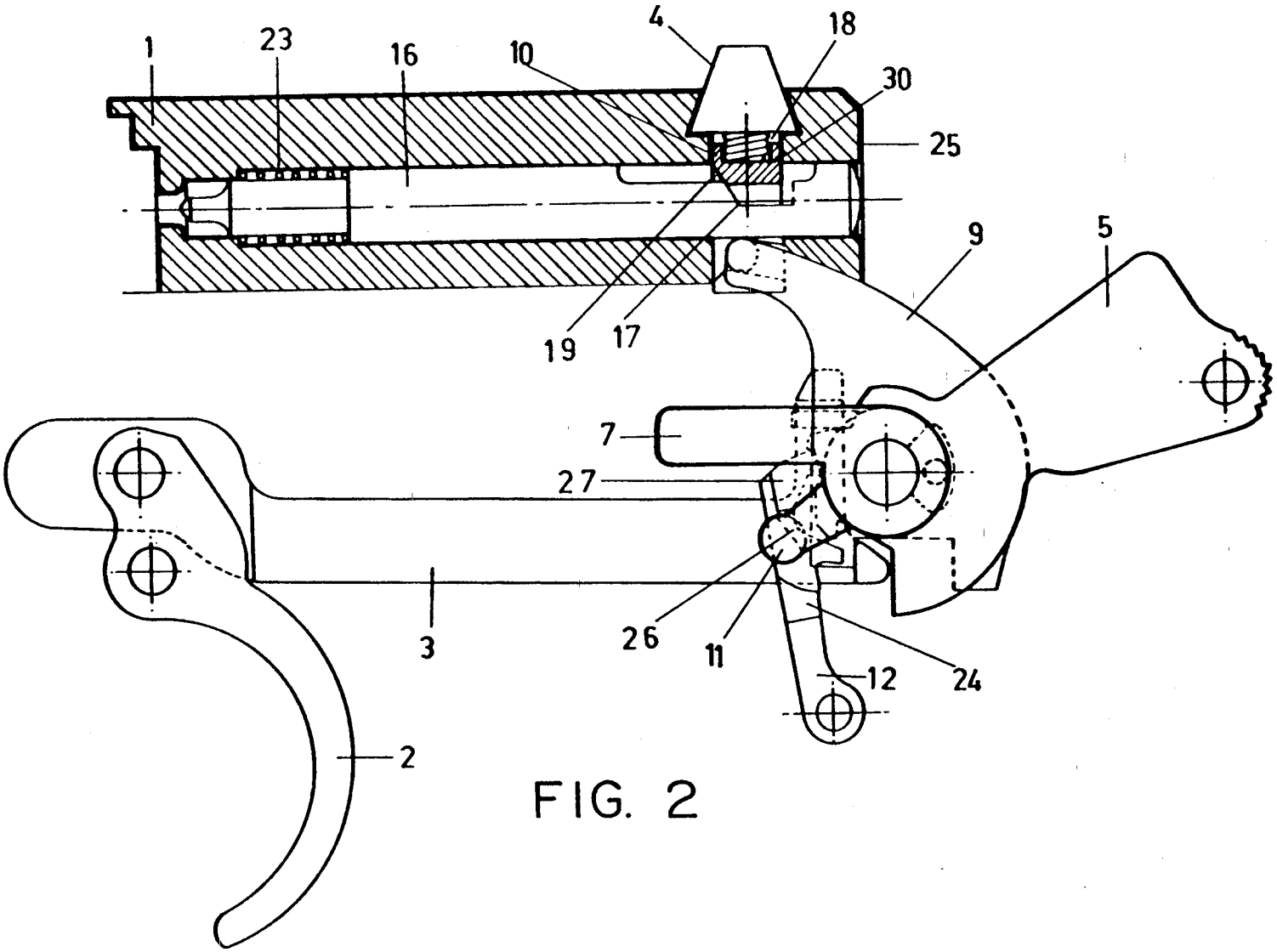
FIG. 2 is a cross-sectional view of the safety device in which the hammer is cocked and the pistol is unlocked.
Figure 3:
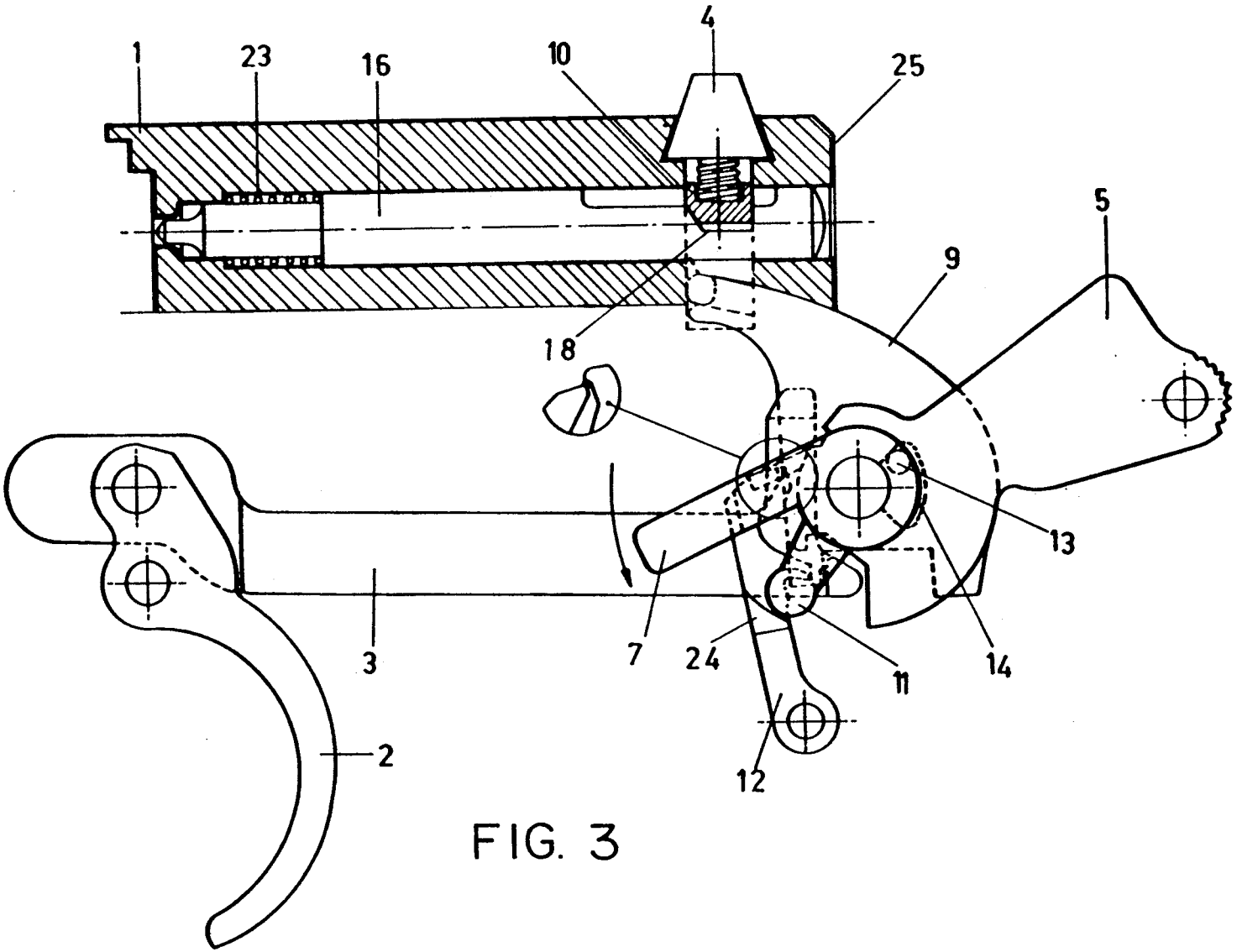
FIG. 3 is a cross-sectional view of the safety device in which the hammer is cocked with the uncocking mechanism activated.
Figure 4:
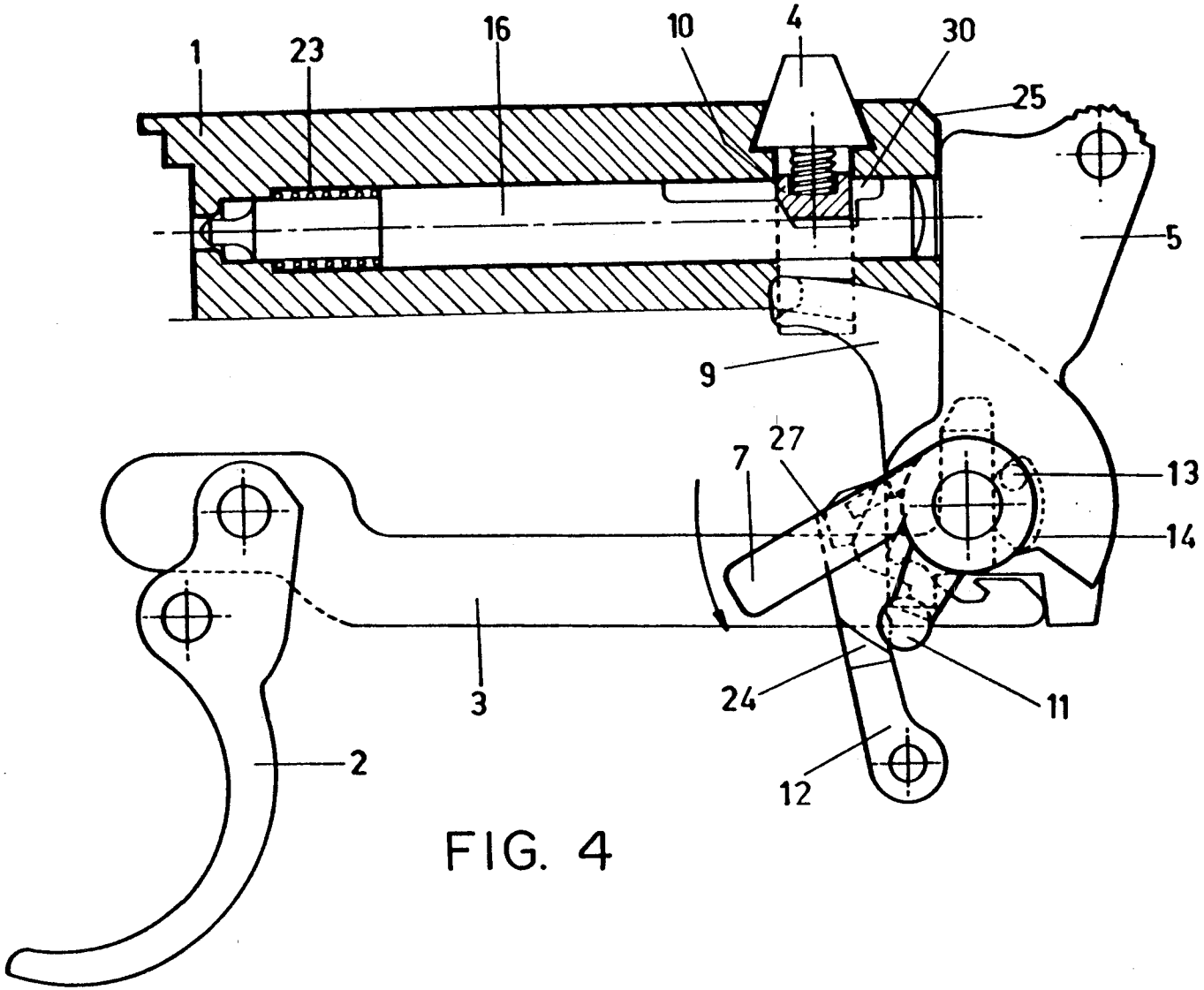
FIG. 4 is a cross-sectional view of the safety device in which the hammer, after uncocking, is leaning against the stop face of the hammer in slide.
Figure 5:
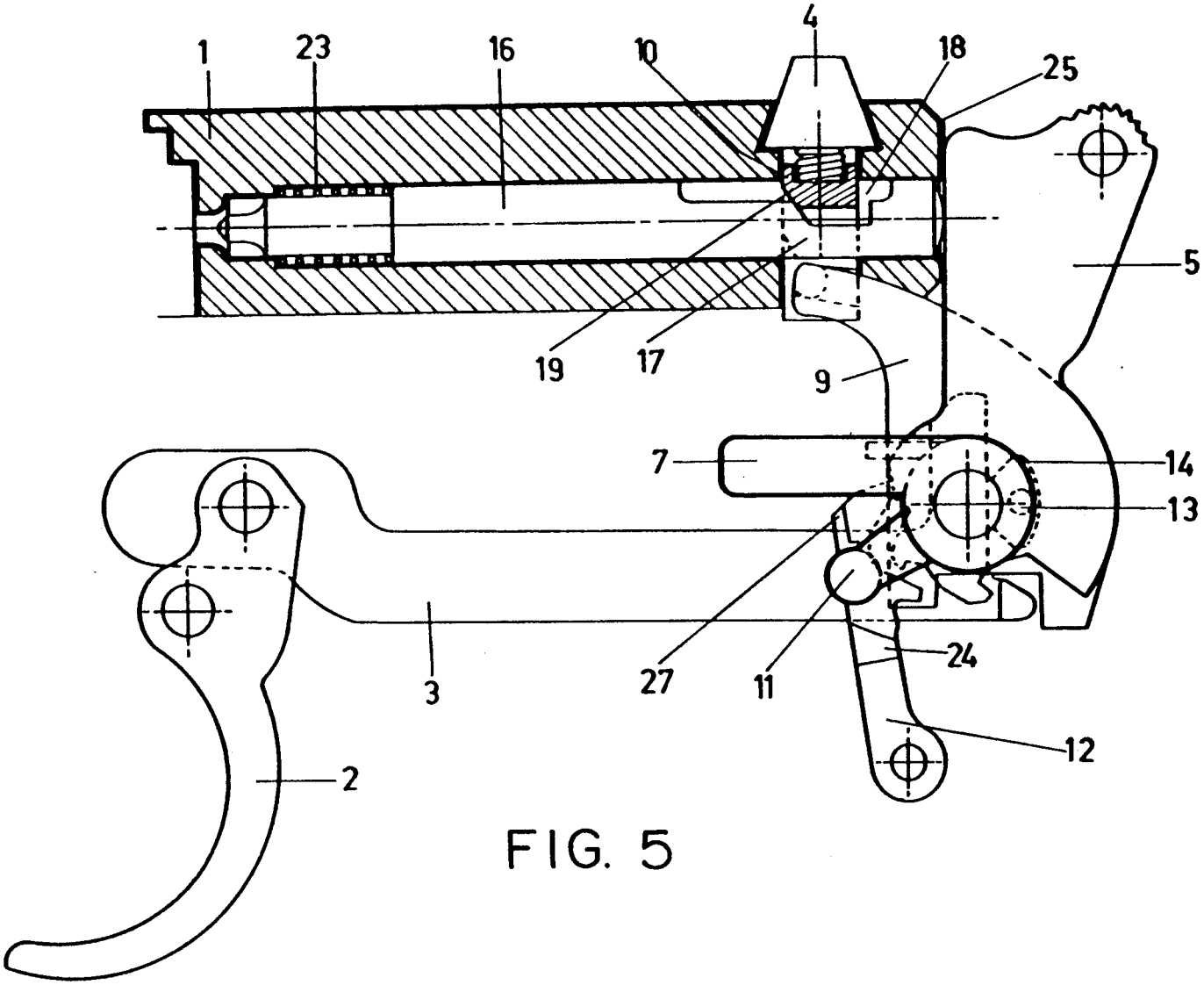
FIG. 5 is a cross-sectional view of the safety device in which the hammer is uncocked and the pistol is unlocked.

For the best comprehension of the layout of components of the safety device, which is the object of the present invention, the parts such as the slide (1), the trigger (2), the trigger bar (3), and the rear sight (4) are shown in FIGS. 1–6, without any specific function relative to the present safety device.

According to the attached figures, the improved safety device, a of this invention is of the type mounted on a pistol frame. The device includes a three-position rotary safety register in which a raised position (A) actuates the pistol locking mechanism, a lowered position (B) actuates the hammer uncocking mechanism and a horizontal neutral position (C) with automatic return from position (B) allows shooting with the pistol. This safety device is composed of two actuating keys (6,7) located one on each side of the pistol such that the right-hand key (6) has an axle (8) at right angles with the pistol on which are mounted the hammer (5) and the firing pin block lever (9) and the left-hand key (7) has a means to be affixed to said axle (8). The device also includes a cylindrical projection (11) on arm (26') parallel to said axle (8) which blocks the hammer sear actuation on the stop face (27) of the hammer sear (12) when the keys (6,7) are in the pistol locking position. The device is further characterized by the fact that the right-hand key (6) is fitted with a pin (13) parallel to the axle (8) of said key. This pin acts in a groove (14) adjacent to the hole (15) of firing pin block lever (9). A firing pin (16) is fitted with a ramp (17) in a groove (18) which houses a firing pin block (10). The firing pin block (10) is provided with a ramp (19) at a lower part of its horizontal stop (30). Extending downwards on the side of firing pin block (10) is a projection (19) having an internal face with a groove (19'') in which the cylindrical projection (9') of firing pin block lever (9) operates. The device further includes a set of pin (20), spring (21) and stop pin (22) actuating on the left-hand key (7) apart from a pin (28) and a respective spring (29) which define, by clicking, positions (A) and (C) of safety key.

FIG. 1 illustrates a left-hand side view of the pistol which, incorporates the present device, in which the number (7) indicates the left-hand key of the safety register which is installed in the pistol frame as well as the three positions that said second key (7) can occupy, i.e. a raised position (A) for pistol locking, a lowered position (B) which actuates hammer uncocking and a horizontal neutral position (C) which allows actual shooting with the pistol.

To achieve hammer (5) uncocking in complete safety (FIGS. 2, 3 and 4), it is just necessary to press on one of the keys (6,7) of the safety register, so that both keys go down to a lowered position (B) where at the pressing pin (20) acts on projection (26') of left hand key (7) against spring (21) of same. When keys (6,7) of the safety register shift to lowered position (B), the pin (13) of right-hand key (6) actuates on the upper portion of the internal wall of groove (14) of firing pin block lever (9) so that said firing pin block lever (9) makes a rotational motion and its projection (9') acting groove (19'') lowers the block (10) of firing pin (16) against the groove (18) of same, specifically pressing on the ramp (17) provided in said groove and making the firing pin (16) move forwards, against the corresponding spring (23), simultaneously with the action of the cylindrical projection (11) of arm (26') of left-hand key (7) over a side projection (24) provided in the sear (12) which makes the sear (12) release the hammer (5) which strikes down on hammer stop (25) in slide (1) without reaching the firing pin (16) previously pushed back.

Figure 6:
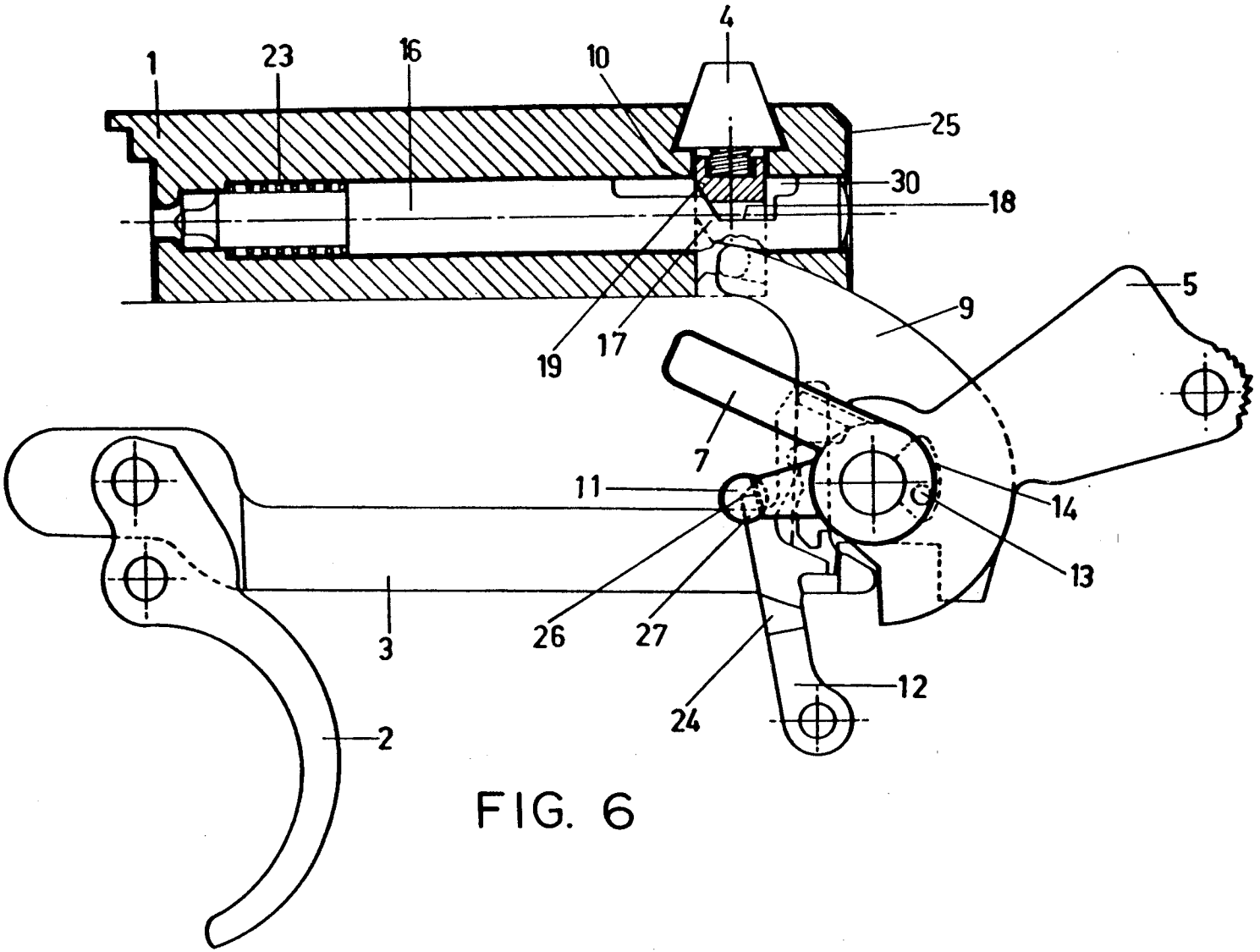
FIG. 6 is a cross-sectional view of the safety device in which the hammer is cocked and the pistol is locked.

In turn, pistol locking is achieved by positioning keys (6,7) of the safety register in position (A) so that the stop face (26) of cylindrical projection (11) of arm (26') of left-hand key (7) now blocks motion of the sear (12) acting on the stop face (27)of same thereby blocking release of the hammer (5) and consequent triggering of the pistol. Such a locking state can be obtained not only with hammer (5) uncocked, but also with the hammer cocked as illustrated in FIG. 6. In this position, cylindrical pin (26'') of key (7) interferes with the face (1') of the notch in slide (1) making it impossible to move it back manually.

Figure 7A:
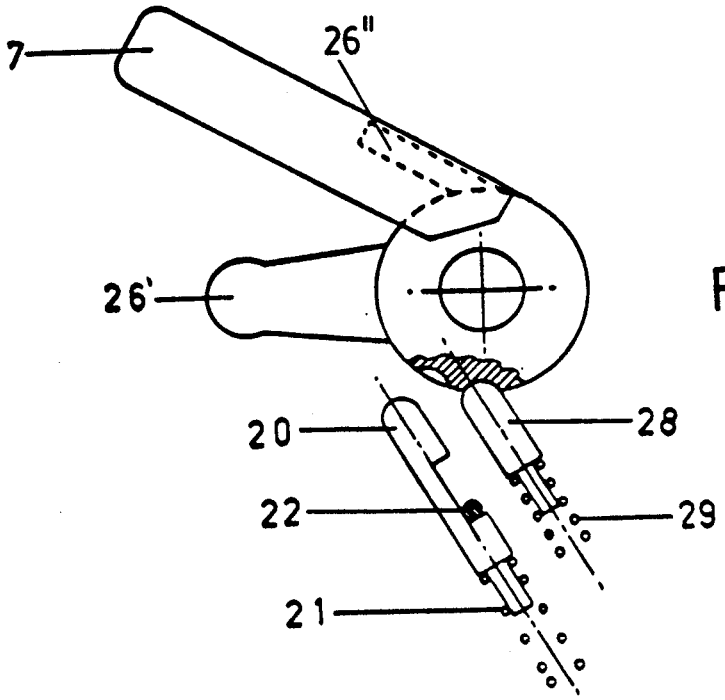
FIGS. 7A–7C are side views of the left-hand key and the set of two pins with respective springs which actuate on said key.
Figure 7B:
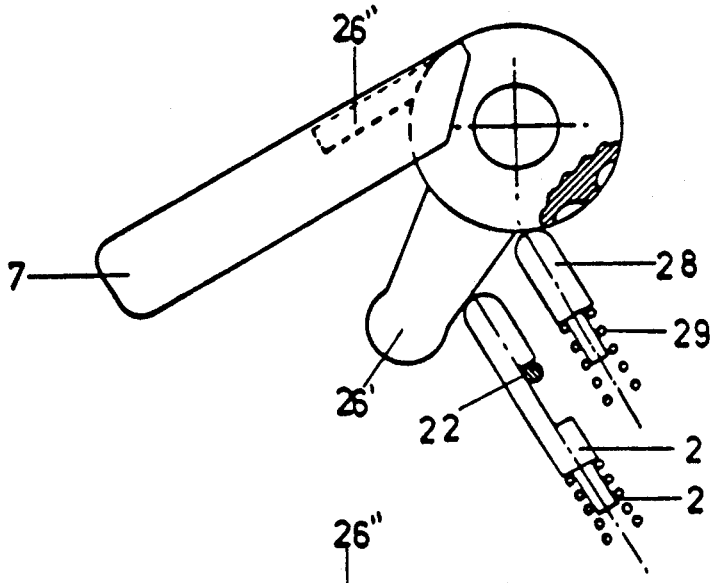
Figure 7C:
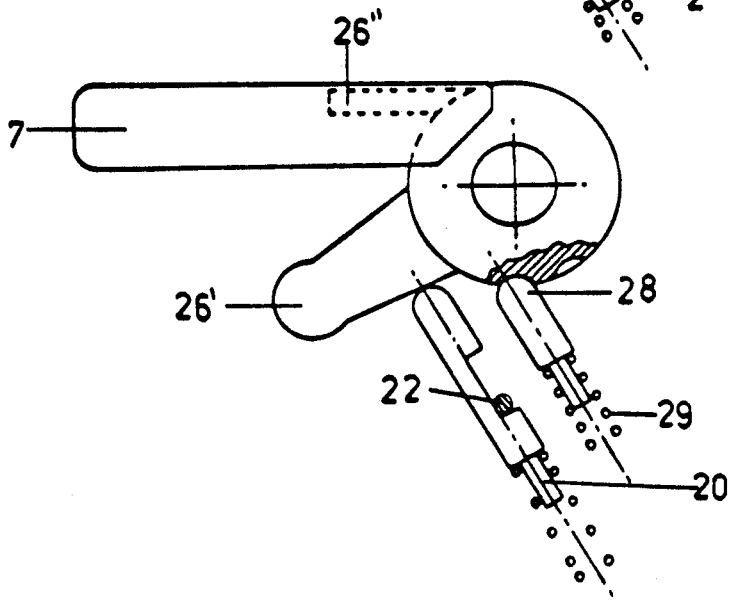

In order to have safety register keys (6,7) shift automatically from the lowered position (B) to the horizontal position (C) leaving the pistol in an unlocked condition and allowing double action shooting after uncocking of hammer, a set comprising pin (20), spring (21) and stop pin (22) is provided which acts on arm (26) of the left-hand key (7) as illustrated in FIG. 7. When saftey register keys (6,7) shift from horizontal position (C) to position (B), the left-hand key (7) presses pin (20), which motion is limited by the stop pin (22), against spring (21) which after pressure on keys (6,7) has ceased, moves the same up to the horizontal position (C) since upward motion of pin (20) is also limited by the stop pin (22). To determine exactly positions (A) and (C) and also to maintain these positions, a further pin (28) and a respective spring (29) with clicking function, acting on second key (7) are provided.

Figure 8:
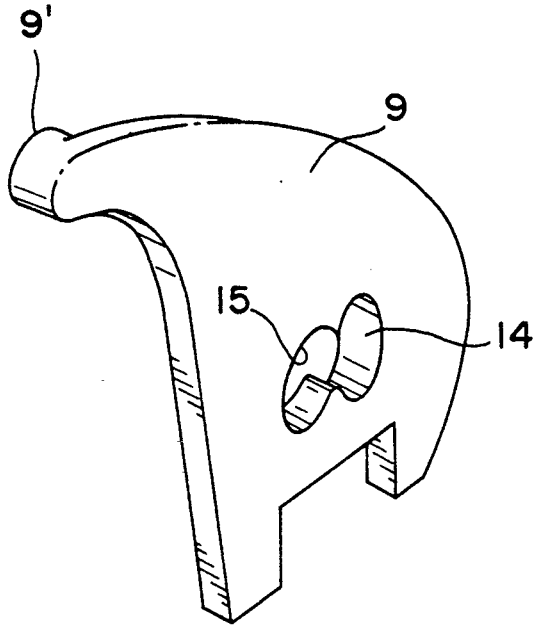
FIG. 8 is a perspective view of the firing pin block lever.

A preferred construction for the firing pin block lever (9) is illustrated in FIG. 8. As shown therein, the firing pin block lever (9) is fitted with a groove (14) in which acts pin (13) of right-hand key (6). This groove is adjacent to a rear portion of hole (15) through which passes axle (8) of safety register key (6). At the upper extreme end of firing pin block lever (9), there is a cylindrical projection (9') which actuates firing pin block (10).

Figure 9:
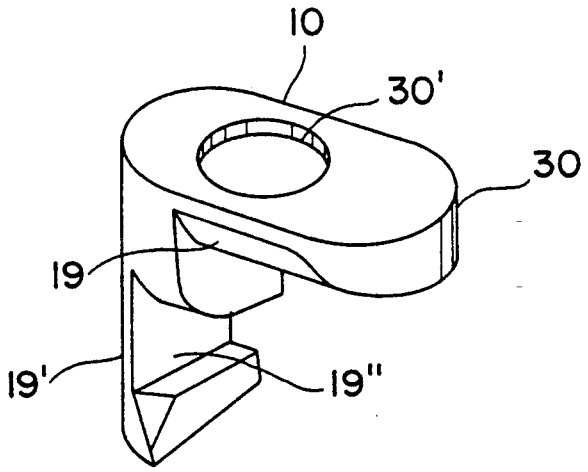
FIG. 9 is a perspective view of the firing pin block.

FIG. 9 illustrates a preferred form of construction for the firing pin block (10) in which it can be observed that said firing pin block (10) is fitted with a horizontal stop (30) in which the rear lower portion is provided with a ramp (19). In the upper flat surface of stop (30), there is a circular cavity (30') to house the respective spring and on the right side of said stop there is a vertical element (19'), extending downwards, with an internal face having a groove (19''), in which runs the cylindrical projection (9') of firing pin block lever (9).

Figure 10:
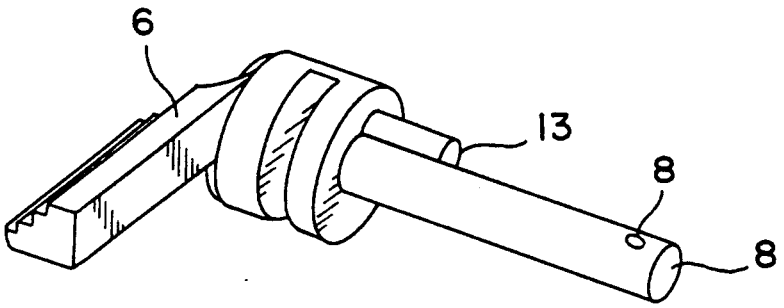
FIG. 10 is a perspective view of the right-hand key.

FIG. 10 illustrates a preferred form of construction for the right-hand safety register key (6) in which it can be observed that the pin (13) has a rearward-sideward position in relation to axle (8) parallel to same and that on said axle (8) there is a hole (8') for the introduction of a pin to make both safety register keys (6,7) act jointly.

Figure 11:
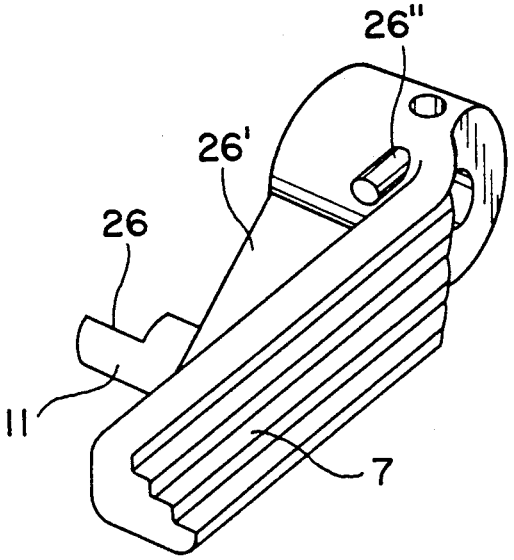
FIG. 11 is a perspective view of the left-hand key.

FIG. 11 illustrates a preferred form for the left-hand key (7), known as state of art, in which the arm (26') with its cylindrical projection (11) and the stop face (26) of same can be observed.

Figure 12:
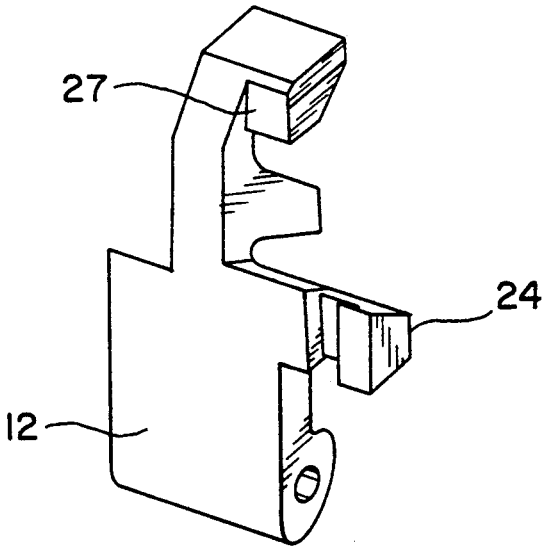
FIG. 12 is a perspective view of the sear.

FIG. 12 illustrates a preferred form of construction for the sear (12) of hammer (5), in which the side projection (24) in trapezoidal shape and the front face of stop (27) of the upper part of said sear can be observed.

I claim:

1. An "IMPROVED SAFETY DEVICE FOR SEMIAUTOMATIC PISTOL" of a kind assembled in a frame of pistol, including a three-position rotatory safety register in which a raised position (A) actuates a pistol locking mechanism; a lowered position (B) actuates an uncocking mechanism of a hammer (5) with automatic return to a horizontal neutral position (C) intended to allow shooting with the pistol; said safety register being composed of two actuating keys installed on each side of the pistol, a first key (6) being provided with an axle (8) at a right angle with the pistol on which are mounted the hammer (5) and a firing pin block lever (9) and a second key (7) which has means for fixing said axle (8); an arm (26') provided with a first cylindrical projection (11) parallel to said axle (8) intended to block a hammer sear (12) acting on a stop face (27) of same when said keys (6,7) are positioned to lock the pistol, and being characterized by the fact that the first key (6) is provided with a pin (13) parallel to the axle (8) of said first key; and the firing pin block lever (9) is endowed with a groove (14) adjacent to a hole (15) and provided with a second cylindrical projection (9'); a firing pin (16) provided with a first ramp (17) in a respective groove (18) to house a firing pin block (10); said firing pin block (10) being provided with a horizontal stop (30) with a second ramp (19) in its lower front portion and having in its upper flat surface a circular cavity (30') to house a respective spring and said firing pin block (10) having a side downward projection (19') with a groove (19''); and a set of a pin (20), a spring (21) and a stop pin (22) acting on an arm (26') of said second key (7).

2. A "SAFETY DEVICE", according to claim 1, characterized by the fact that when said safety register keys (6,7) shift to the lowered position (B), the pin (13) of said first key (6) acts on an upper portion of an internal wall of the groove (14) in the firing pin block lever (9) so that said firing pin block lever (9) makes a rotational motion and through the second cylindrical projection (9') lowers the firing pin block (10) against the groove (18) of the firing pin (16) and specifically the second ramp (19) provided in said firing pin block (10) against the first ramp (17) in said groove (18), so that the firing pin (16) moves forwards against the respective spring (23), simultaneously with action of the first cylindrical projection (11) of arm (26') of the second key (7) on a side projection (24) provided in the sear (12) so that said sear (12) releases the hammer (5) which strikes down on a stop (25) of the hammer (5) in a slide (1) without reaching the firing pin (16) which had been previously pushed back.

3. A "SAFETY DEVICE", according to claim 1, characterized by the fact that when the safety register keys (6,7) shift from the horizontal position (C) to the lowered position, the arm (26') in the second key (7) presses the pin (20), which motion is limited by the stop pin (22), against the spring (21) which after pressure on the keys (6,7) has ceased, pushes these back to the horizontal position (C).

4. A "SAFETY DEVICE", according to claim 1, characterized by the fact that the pin (13) of first key (6) takes a side rearward position in relation to the axle (8).

* * * * *